US012163748B2

(12) United States Patent
Perle et al.

(10) Patent No.: US 12,163,748 B2
(45) Date of Patent: Dec. 10, 2024

(54) FIREARM ASSEMBLY

(71) Applicants: Nathaniel J. Perle, Plainfield, IL (US); Collin M. Perle, Plainfield, IL (US)

(72) Inventors: Nathaniel J. Perle, Plainfield, IL (US); Collin M. Perle, Plainfield, IL (US)

( * ) Notice: Subject to any disclaimer, the term of this patent is extended or adjusted under 35 U.S.C. 154(b) by 0 days.

(21) Appl. No.: 18/136,914

(22) Filed: Apr. 20, 2023

(65) Prior Publication Data

US 2023/0341204 A1 Oct. 26, 2023

Related U.S. Application Data

(60) Provisional application No. 63/334,816, filed on Apr. 26, 2022.

(51) Int. Cl.
*F41A 19/46* (2006.01)

(52) U.S. Cl.
CPC ..... *F41A 19/46* (2013.01)

(58) Field of Classification Search
CPC ..... F41A 19/12; F41A 19/42; F41A 19/43; F41A 19/44; F41A 19/45; F41A 19/46
USPC ..... 42/70.05, 69.03; 89/139–146, 149, 150
See application file for complete search history.

(56) References Cited

U.S. PATENT DOCUMENTS

| | | | | |
|---|---|---|---|---|
| 2,471,779 | A * | 5/1949 | Roemer | F41A 19/46 89/142 |
| 3,776,095 | A * | 12/1973 | Atchisson | F41A 11/02 89/149 |
| H926 | H * | 6/1991 | Mahtook | 42/77 |
| 8,985,007 | B2 * | 3/2015 | Larson | F41A 5/18 89/142 |
| 9,151,558 | B1 * | 10/2015 | Hirt | F41A 19/44 |
| 10,101,109 | B2 * | 10/2018 | Caudle | F41A 11/02 |
| 10,436,535 | B1 * | 10/2019 | Bradshaw | F41A 19/46 |
| 2018/0080732 | A1 * | 3/2018 | Brown | F41A 19/12 |

* cited by examiner

*Primary Examiner* — John Cooper
(74) *Attorney, Agent, or Firm* — Bennet K. Langlotz; Langlotz Patent & Trademark Works, LLC

(57) ABSTRACT

A firearm assembly has a lower receiver frame having an upper surface defining a horizontal plane, a hammer pivotally connected to the frame, a sear pivotally connected to the frame and movable between a retention position operable to restrain the hammer and a release position operable to enable striking motion of the hammer, an elongated link having a planar form overlaying the upper surface of the frame, the elongated link having opposed major upper and lower surfaces, a forward end, and an opposed rear end, and movable between a link forward position and a link rearward portion, the link forward end having a bolt engagement element, the elongated link having a sear engagement element protruding away from at least one of the upper and lower surfaces, and the sear having a lateral extension operably engaged by the sear engagement element.

15 Claims, 13 Drawing Sheets

FIREARM ASSEMBLY

CROSS-REFERENCE TO RELATED APPLICATION

This application claims the benefit of U.S. Provisional Patent Application No. 63/334,816 filed on Apr. 26, 2022, entitled "SEAR LINK," which is hereby incorporated by reference in its entirety for all that is taught and disclosed therein.

FIELD OF THE INVENTION

The present invention relates to firearms, and more particularly to a firearm assembly that enables a firearm to function in a semi-automatic or automatic firing mode in a synchronized way with the use of the sear.

BACKGROUND AND SUMMARY OF THE INVENTION

As is described in U.S. Pat. No. 9,151,558 to Hirt et al., which is herein incorporated by reference in its entirety for all that is taught and disclosed therein, there are several challenges associated with automatic firearms, particularly as their size is reduced. For example, reduction in the bolt carrier's length increases the distance between the sear and the bolt carrier. In addition, some prior art designs for tripping the sear of an automatic firearm make the bolt carrier more prone to mechanical failure because of additional mass. Furthermore, some prior art designs for automatic firearms prevent the use of the firearm in semi-automatic firing mode. Therefore, a need exists for a new and improved firearm assembly that enables a firearm to function in a semi-automatic or automatic firing mode in a synchronized way with the use of the sear. In this regard, the various embodiments of the present invention substantially fulfill at least some of these needs. In this respect, the firearm assembly according to the present invention substantially departs from the conventional concepts and designs of the prior art, and in doing so provides an apparatus primarily developed for the purpose of enabling a firearm to function in a semi-automatic or automatic firing mode in a synchronized way with the use of the sear.

The present invention provides an improved firearm assembly, and overcomes the above-mentioned disadvantages and drawbacks of the prior art. As such, the general purpose of the present invention, which will be described subsequently in greater detail, is to provide an improved firearm assembly that has all the advantages of the prior art mentioned above.

To attain this, the preferred embodiment of the present invention essentially comprises a lower receiver frame having an upper surface defining a horizontal plane, a hammer pivotally connected to the lower receiver frame, a sear pivotally connected to the lower receiver frame and movable between a retention position operable to restrain the hammer and a release position operable to enable striking motion of the hammer, an elongated link having a planar form overlaying the upper surface of the lower receiver frame, the elongated link having opposed major upper and lower surfaces, a forward end, and an opposed rear end, and movable between a link forward position and a link rearward portion, the link forward end having a bolt engagement element, the elongated link having a sear engagement element protruding away from at least one of the upper and lower surfaces, and the sear having a lateral extension operably engaged by the sear engagement element. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
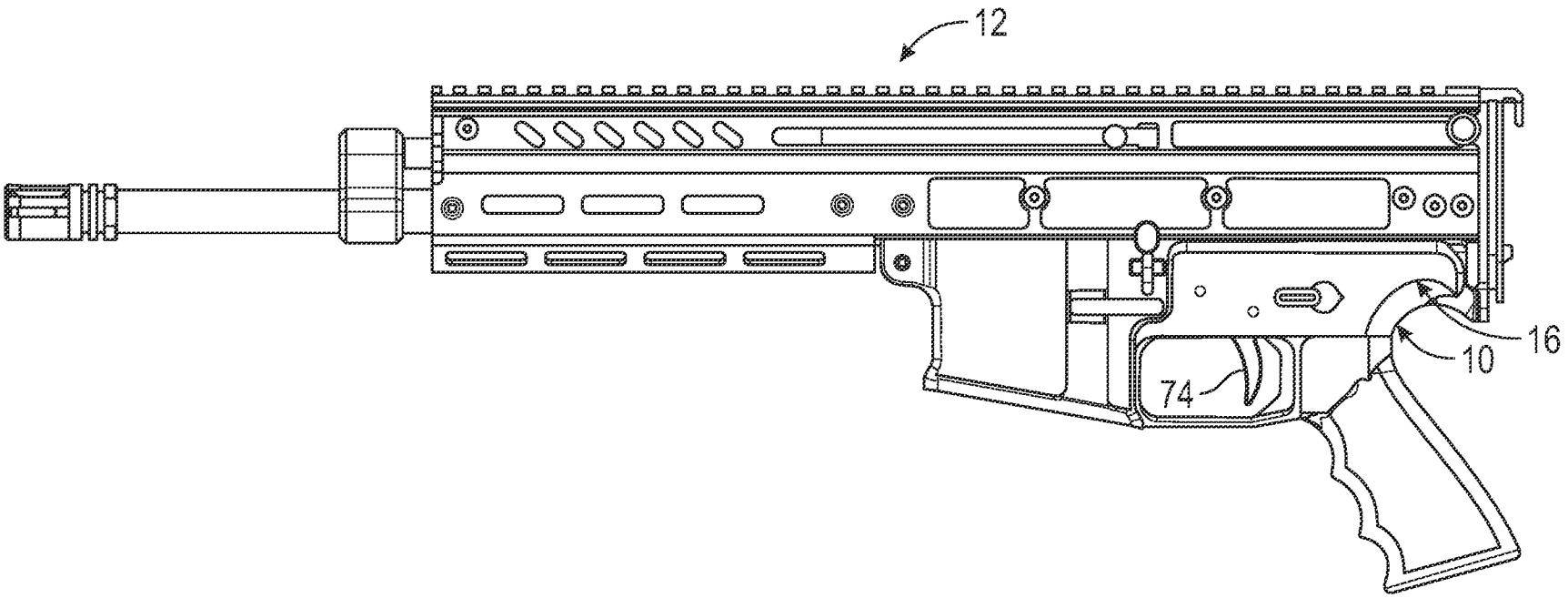
FIG. 1 is a left side view of the current embodiment of a firearm assembly constructed in accordance with the principles of the present invention forming a complete rifle.

An embodiment of the firearm assembly of the present invention is shown and generally designated by the reference numeral 10.

Figure 2:
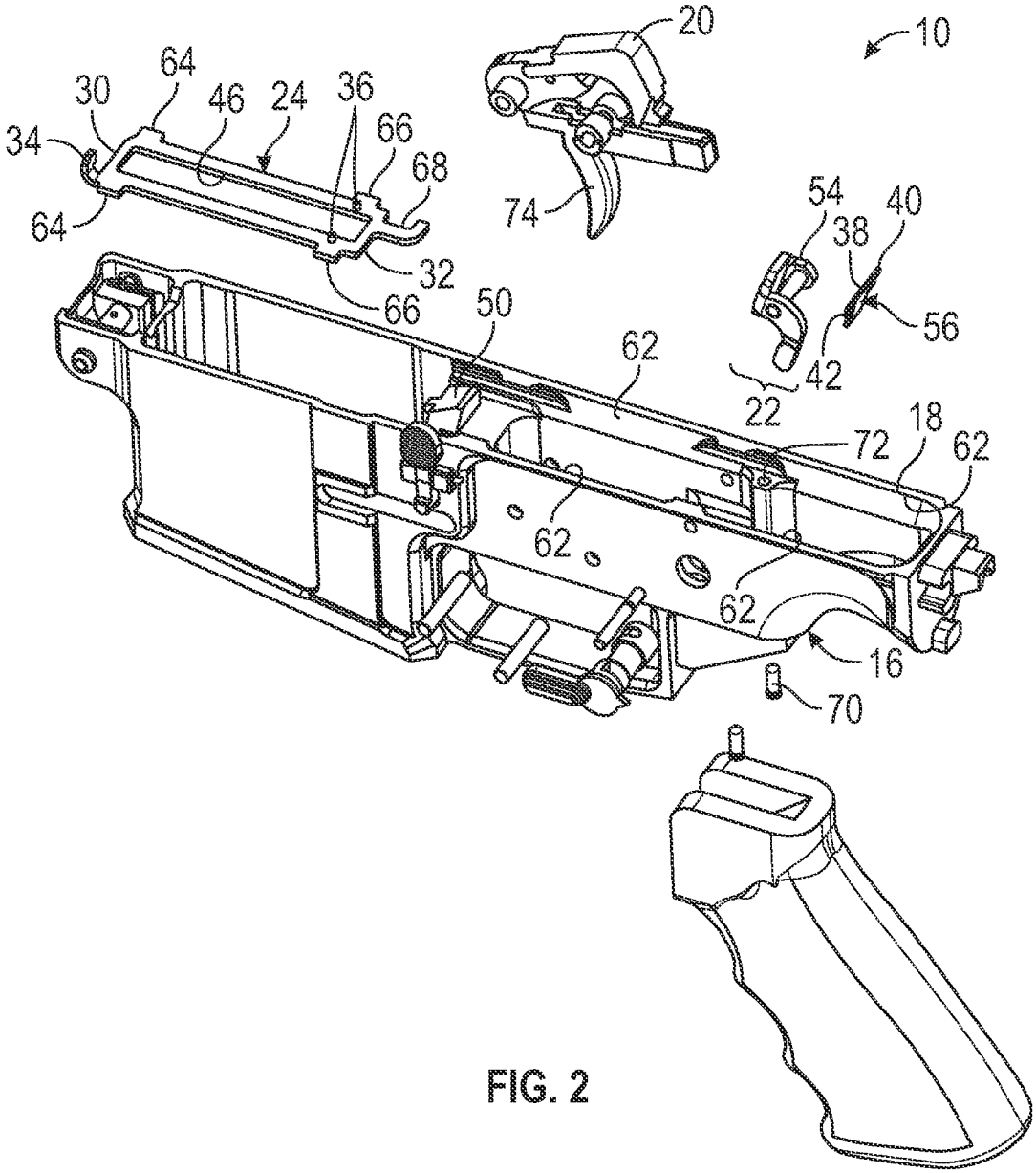
FIG. 2 is an exploded view of the lower receiver assembly of the firearm assembly of FIG. 1.
Figure 3A:
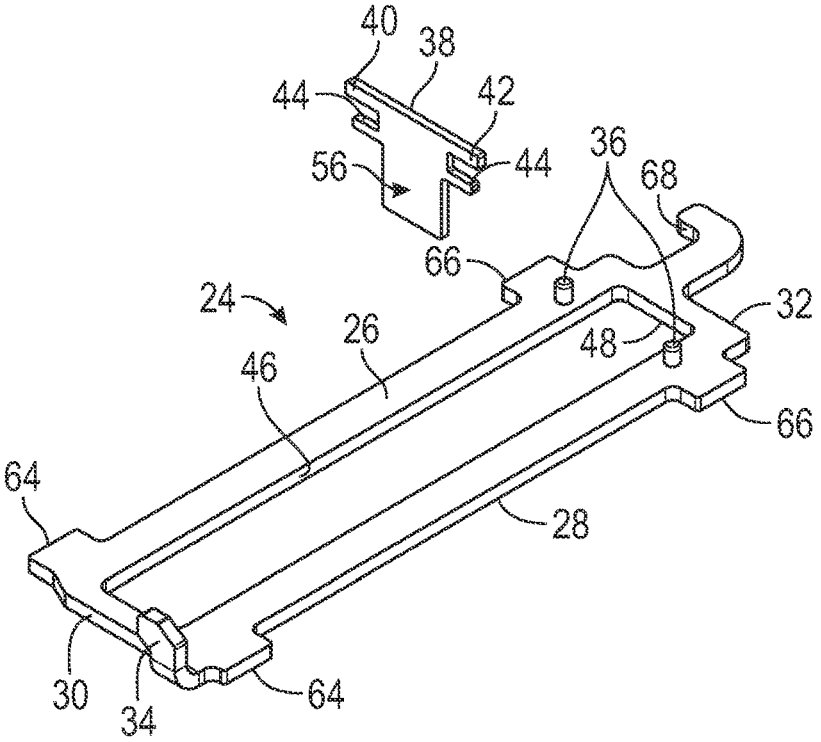
FIG. 3A is a top isometric exploded view of the elongated link and sear engagement element of FIG. 2.
Figure 3B:
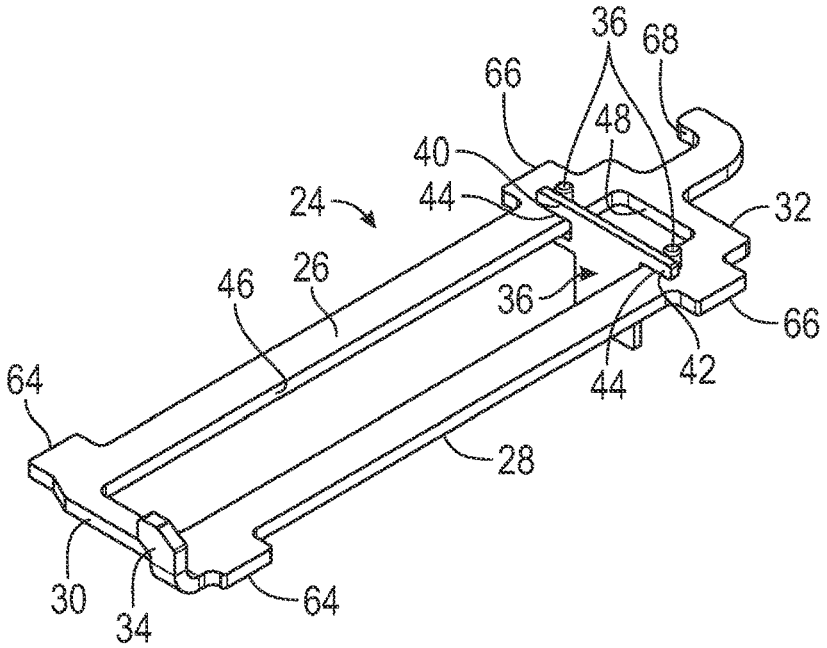
FIG. 3B is a top isometric view of the elongated link of FIG. 2 with the sear engagement element attached.
Figure 3C:
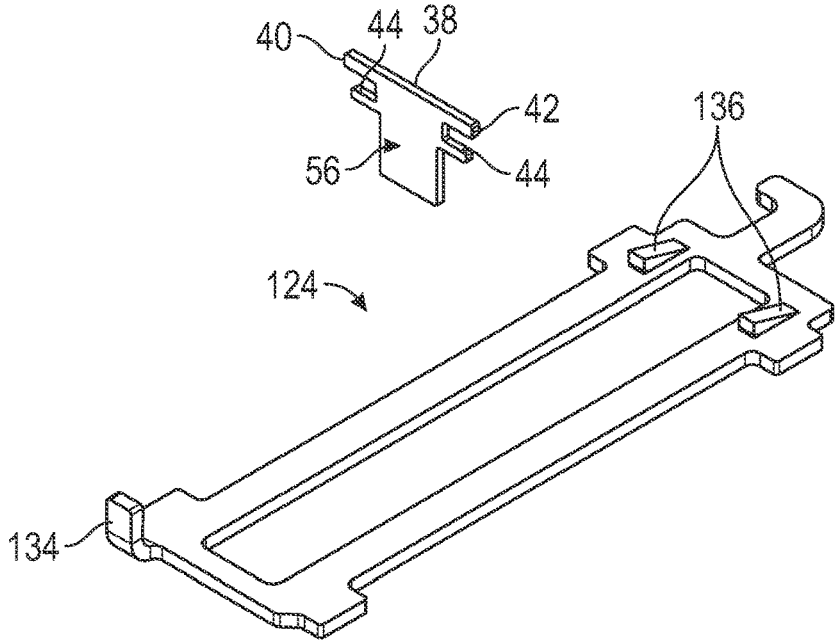
FIG. 3C is a top isometric view of a first alternative embodiment of the elongated link with a detached sear engagement element.
Figure 3D:
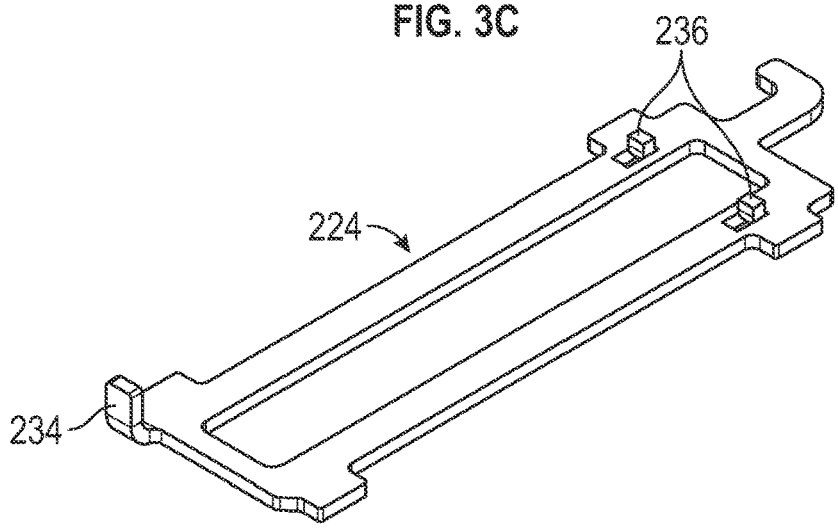
FIG. 3D is a top isometric view of a second alternative embodiment of the elongated link.
Figure 3E:
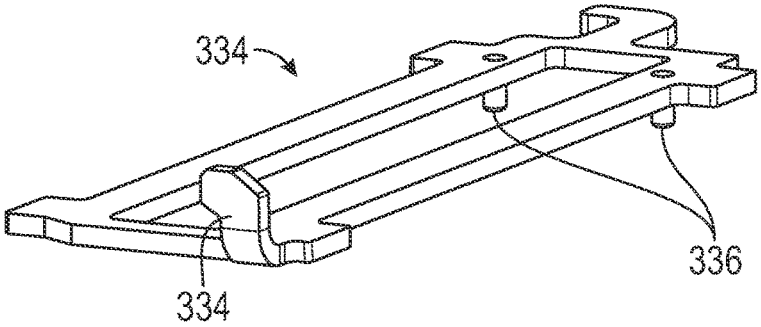
FIG. 3E is a top isometric view of a third alternative embodiment of the elongated link.
Figure 5:
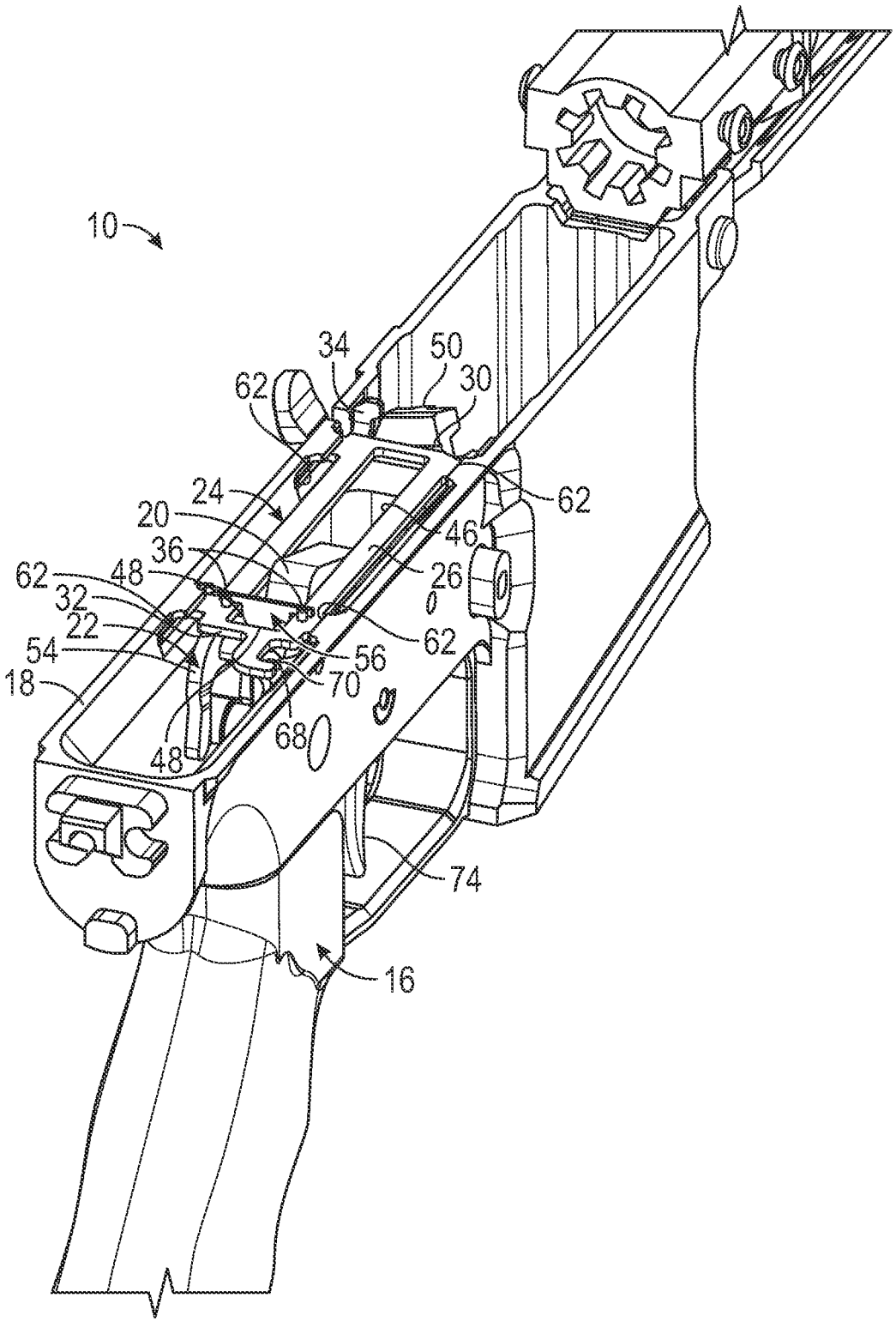
FIG. 5 is a top isometric view of the firearm assembly of FIG. 1.

FIGS. 1, 2, & 5 illustrate the improved firearm assembly 10 of the present invention. FIGS. 3A & B illustrate an improved elongated link 24 and sear engagement element 36. More particularly, FIG. 1 shows the firearm assembly in use forming a complete rifle 12 having a reciprocating bolt 14 (visible in FIGS. 6B & C). The firearm assembly includes a lower receiver frame 16 having an upper surface 18 defining a horizontal plane. A hammer 20 is pivotally connected to the lower receiver frame. A sear 22 is pivotally connected to the lower receiver frame and movable between a retention position operable to restrain the hammer and a release position operable to enable striking motion of the hammer. The elongated link has a planar form overlaying the upper surface of the frame. The elongated link has opposed major upper and lower surfaces 26, 28, a forward end 30, and an opposed rear end 32. The elongated link is movable between a link forward position and a link rearward portion. The link forward end has a bolt engagement element 34. The elongated link has the sear engagement element protruding away from at least one of the upper and lower surfaces. The sear has a lateral extension 38 operably engaged by the sear engagement element.

Figure 4A:
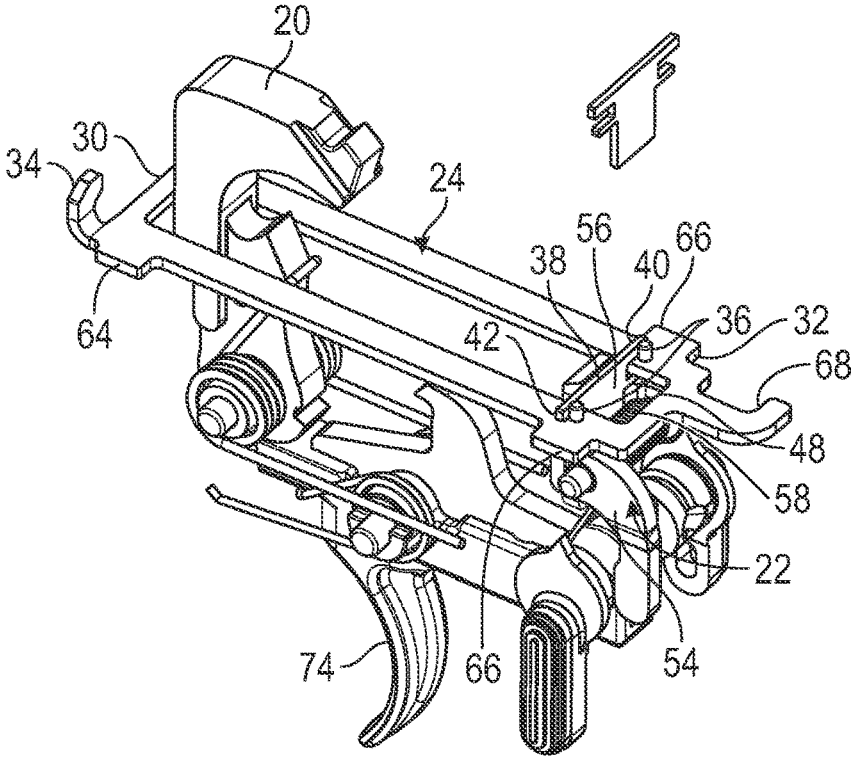
FIG. 4A is a top isometric view of the elongated link of FIG. 2 connected to an M16-style fire control group.
Figure 4B:
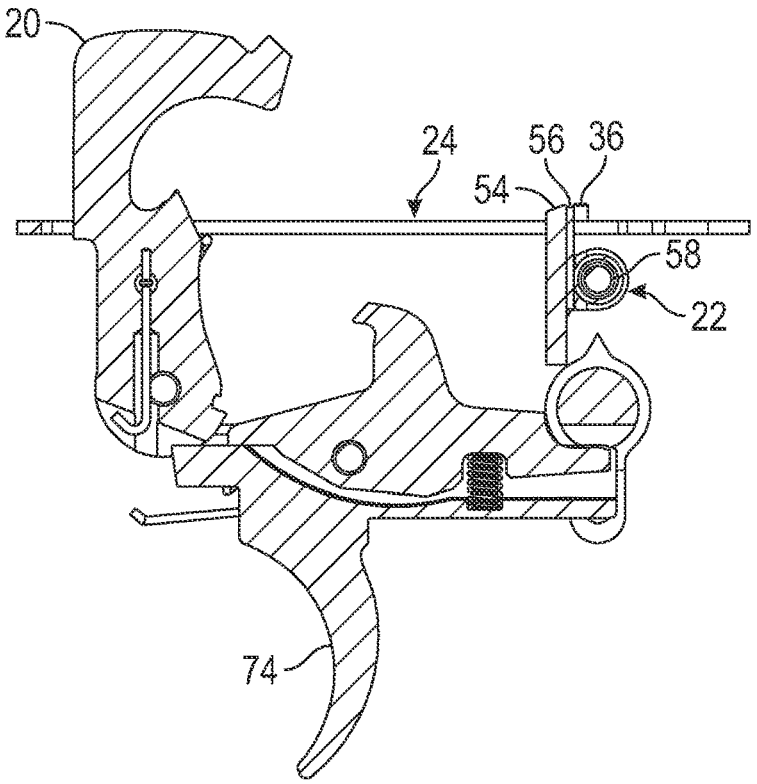
FIG. 4B is a side sectional view of the elongated link of FIG. 2 connected to an M16-style fire control group.

In the current embodiment, the sear engagement element 36 is a vertical protrusion. As is shown in FIGS. 3A-E & 4A-B, the sear engagement element can protrude upwardly from the major upper surface of the elongated link 24, 124, 224 (elements 36, 136, 236 in FIGS. 3A-D) or can protrude downwardly from the major lower surface of the elongated link 324 (element 336 in FIG. 3E). The bolt engagement element 34, 134, 234, 334 always protrudes upwardly. FIGS. 4A-B show the elongated link interfacing with an M16-style fire control group.

The sear 22 includes opposed lateral extensions 40, 42 of the sear in opposite directions, each above a portion of the elongated link 24. The lateral extensions define a gap 44 receiving a portion of the elongated link. The lateral extension 38 extends above a portion of the major upper surface 26 of the elongated link. The lateral extension also extends below a portion of the major lower surface 28 of the elongated link. The sear includes a sear body 54 operably connected to the lower receiver frame 16 and a sear extension 56 that includes the lateral extension. A spring 58 is operably engaged to bias the sear in a selected direction, which is against the sear body in the current embodiment. The sear extension is interposed between a portion of the spring and the sear body.

The elongated link 24 defines an aperture 46 configured to receive a portion of the hammer 20. The aperture has a rear boundary 48. The sear engagement element 36 is forward of the rear boundary. There can be two sear engagement elements 36 located on opposed sides of the aperture.

It should be appreciated that the elongated link 24 links the forward action of a bolt carrier assembly 60 that receives the reciprocating bolt 14 to the sear 22. As a result, once the bolt carrier assembly returns to the forward position and is safely in battery, the sear is tripped and releases the hammer 20, causing a synchronized firing of the rifle 12. The elongated link functions with a variety of sears, timing devices including a lock bar of a forced reset trigger module, and binary triggers. The elongated link is configured to function with a slightly modified FNC SCAR-style semi-automatic bolt carrier, but can be adapted to work with an unmodified FNC SCAR-style full-automatic bolt carrier and other models of firearms. The elongated link provides a linking action between the bolt carrier and the timing device without being in an operable location to the bolt carrier itself.

The elongated link 24 is optimized for being manufactured by sheet metal stamping or laser cutting. However, depending on the exact location of the interface surfaces on the sear 22 and bolt carrier assembly 60, other manufacturing methods may be preferable. These alternative manufacturing methods can include machining the elongated link from solid material, additive manufacturing/3D printing, a weldment of multiple pieces, and extrusion or injection molding processes.

The bolt engagement element 34 is located on the forward end 30 of the elongated link 24 in the current embodiment and can be located in a variety of positions along the forward end as shown in FIGS. 3A-E depending on how the bolt carrier assembly 60 is configured. The bolt engagement element is cut such that the bolt hold open 50 on the lower receiver frame 16 neither obstructs nor is obstructed by the elongated link during operation of either component (shown in FIG. 5). The bolt engagement element can also take the form of an aperture or a pocket that engages with the bolt carrier assembly at the proper point in the cycle of the action of the rifle 12.

The aperture 46 defined by the elongated link 24 encompasses the sear 22 and enables the hammer 20 to pass through the elongated link without interference. The aperture can be widened, lengthened, reduced in width or length, or cut around additional components. The aperture does not need to be rectangular and can be another shape or profile. The aperture can also be stylized for ornamental and cosmetic purposes.

Figure 7A:
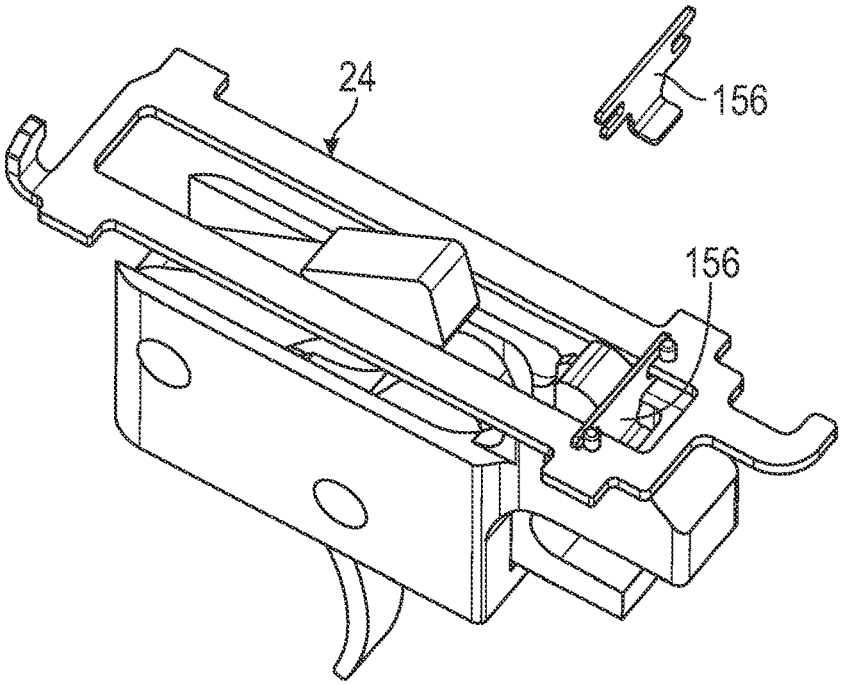
FIG. 7A is a top isometric view of the elongated link of FIG. 2 with a first alternative embodiment of the sear engagement element exploded connected to a forced reset-style fire control group.
Figure 7B:
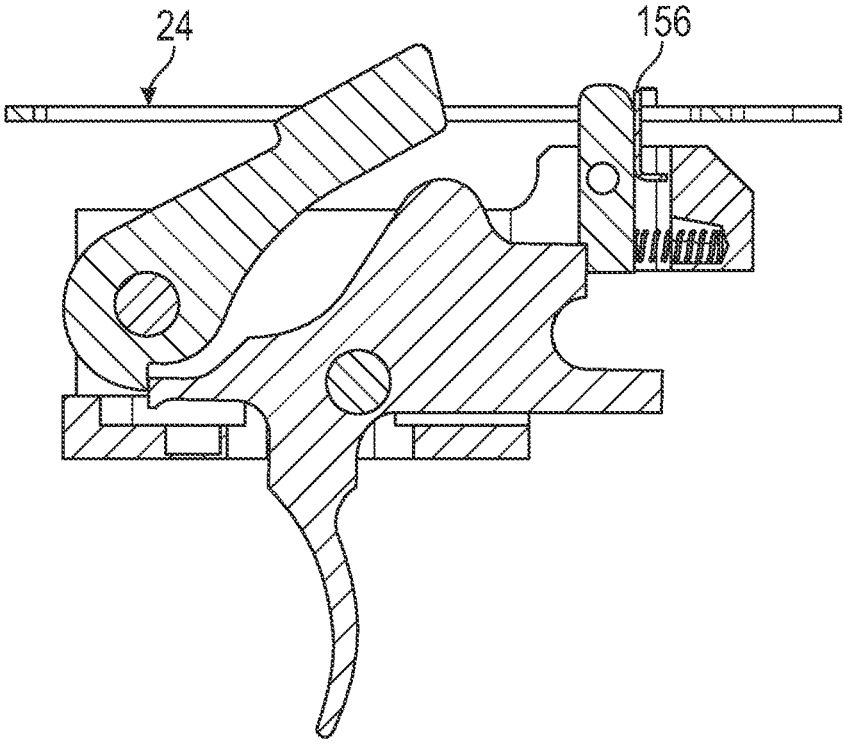
FIG. 7B is a side sectional view of the elongated link of FIG. 2 with the first alternative embodiment of the sear engagement element connected to a forced reset-style fire control group.
Figure 8A:
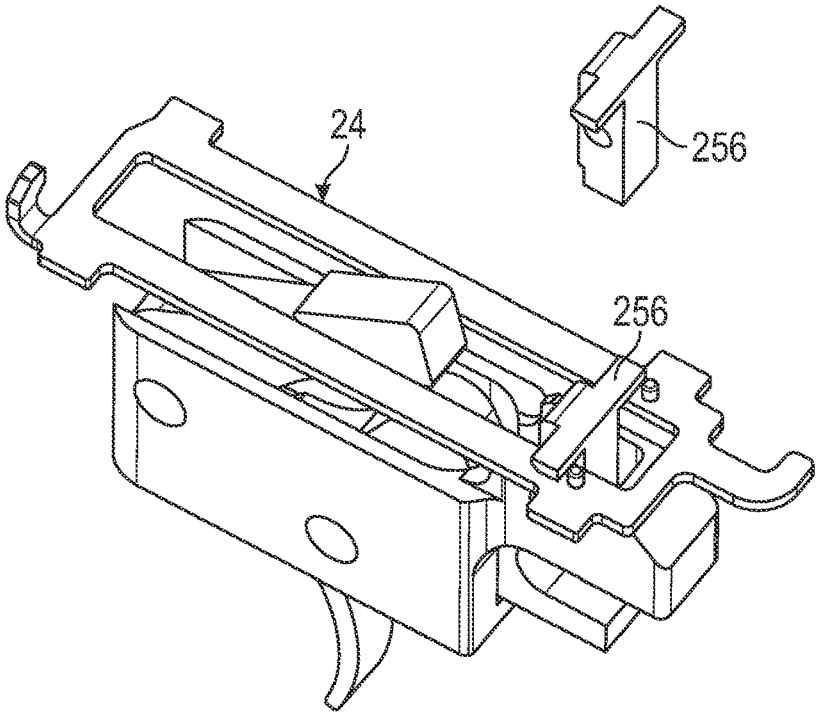
FIG. 8A is a top isometric view of the elongated link of FIG. 2 with a second alternative embodiment of the sear engagement element exploded connected to a forced reset-style fire control group with a custom sear having an extended trip surface.
Figure 8B:
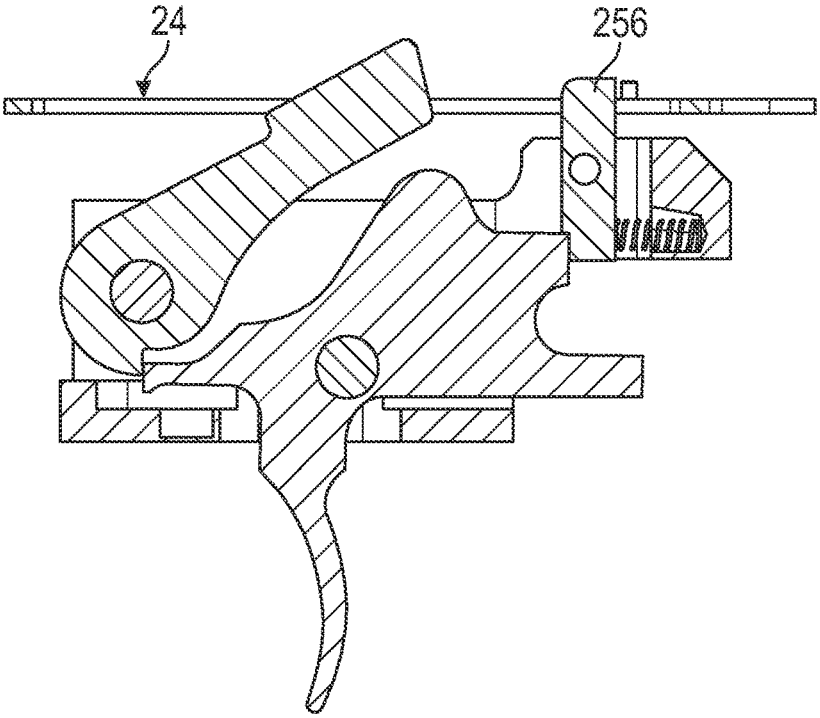
FIG. 8B is a side sectional view of the elongated link of FIG. 2 with the first alternative embodiment of the sear engagement element connected to a forced reset-style fire control group with a custom sear having an extended trip surface.

The sear extension 56 is located within the aperture 46. The sear extension can be a flat surface, but can also be modified to accommodate other sear geometries. For example, a bend or an upset (element 156 in FIGS. 7A-B for use with a forced rest-style fire control group), a center cut out to resemble a tuning fork, a thickened sear extension (element 256 in FIGS. 8A-B for use with a forced rest-style fire control group with a custom sear with an extended trip surface), or an additional piece fastened or welded to the sear body can be added to enable proper function with other styles of sears. The sear engagement element can also have multiple surfaces capable of tripping the sear.

The upper surface 18 of the lower receiver frame 16 defines four guide channels 62. The elongated link 24 includes a pair of male guide rails 64 protruding from the sides at the forward end 30 and a pair of male guide rails 66 protruding from the sides at the rear end 32. The interaction between the pairs of male guide rails and the four guide channels constrains the motion of the elongated link to be in the forward and rearward direction. The pairs of male guide rails can also be one continuous rail on each side, bent upwards or downwards, or be in the flat configuration illustrated. The four guide channels can also be upwards, downwards, or at an angle depending on the clearances and dimensions of the lower receiver frame and the configuration of the male guide rails. The guide channels can also be a single channel on each side, or the guide channels can be female rails that bolt or clip into place on the lower receiver frame. The elongated link can also be configured with a slot or slots running lengthwise that receive a pin or boss connected to the lower receiver frame to constrain the motion of the elongated link to the forward and rearward direction. The elongated link can also include a travel limit 68 that prevents the elongated link from moving too far forward during firing. The travel limit interfaces with a travel detent 70 received in an aperture 72 defined by the lower receiver frame that limits forward travel of the elongated link.

FIGS. 6A-E show a sequence of operation of the rifle 12 with the firearm assembly 10 installed. More particularly, in FIG. 6A, the trigger 74 is pulled with the selector 76 in automatic firing mode. The bolt carrier assembly 60 and the hammer 20 are in the forward position, illustrating the moment a round is fired. The bolt engagement element 34 is pushed forward by the bolt carrier assembly. This action pulls the entire elongated link 24 forward, causing the sear engagement element 36 to push forward on the sear 22, which releases the hammer to go forward and strike the firing pin (not visible) in the bolt carrier assembly. The release of the hammer is timed and controlled by the interaction between the bolt carrier assembly and the bolt engagement element.

Figure 6A:
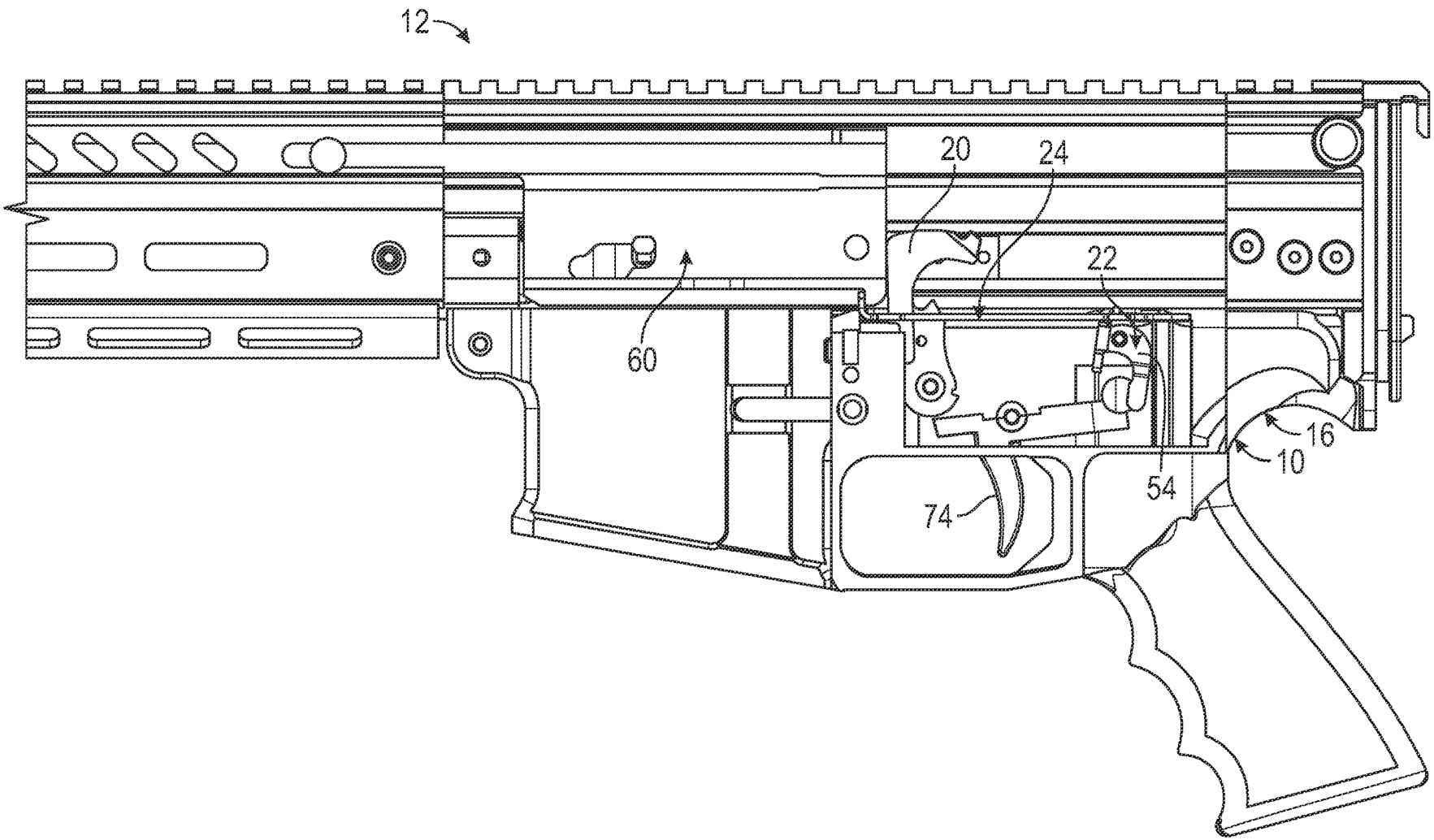
FIG. 6A is a side cutaway view of the firearm assembly of FIG. 1 at the moment a round is fired.
Figure 6B:
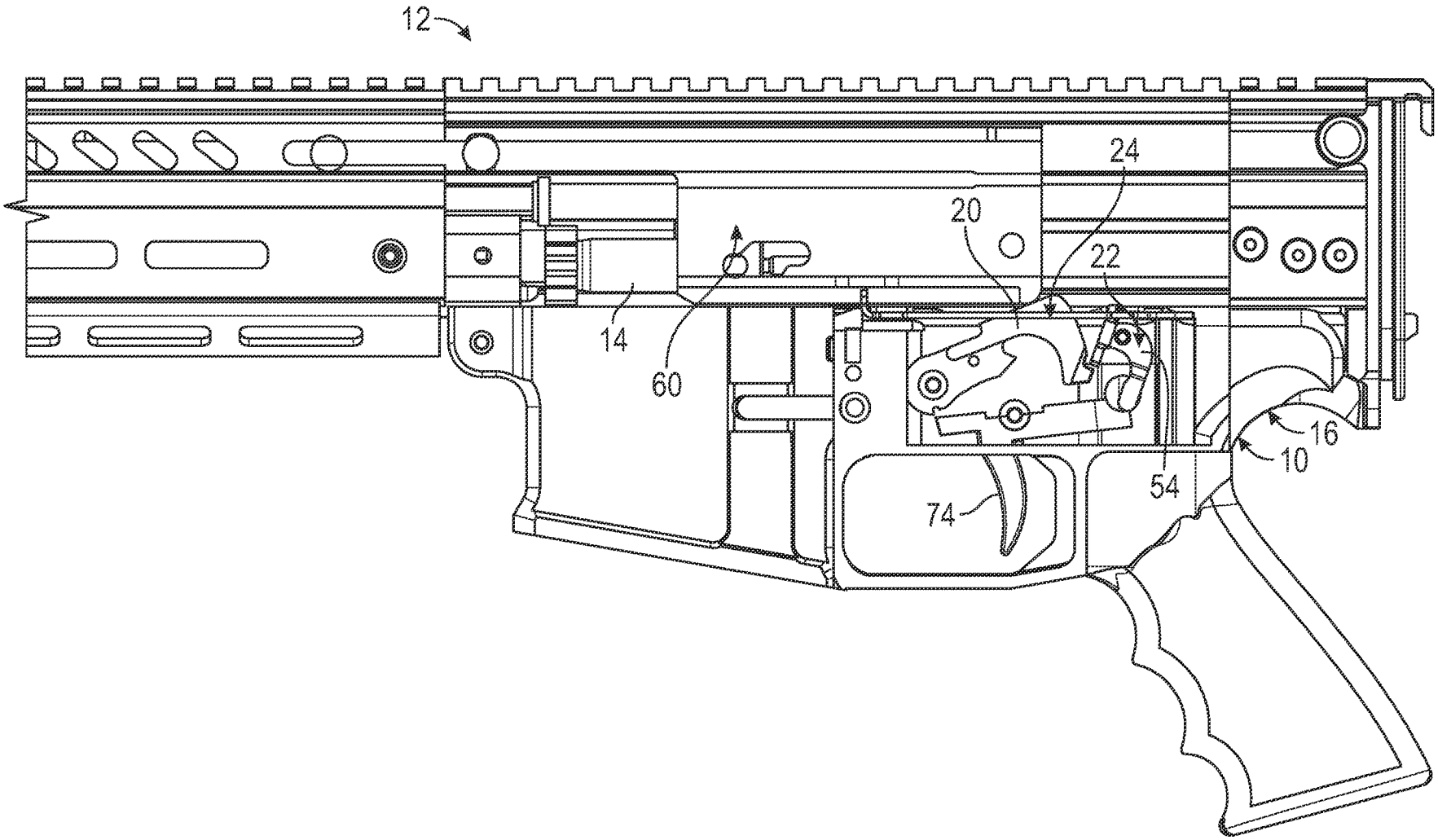
FIG. 6B is a side cutaway view of the firearm assembly of FIG. 1 immediately after a round has discharged.
Figure 6C:
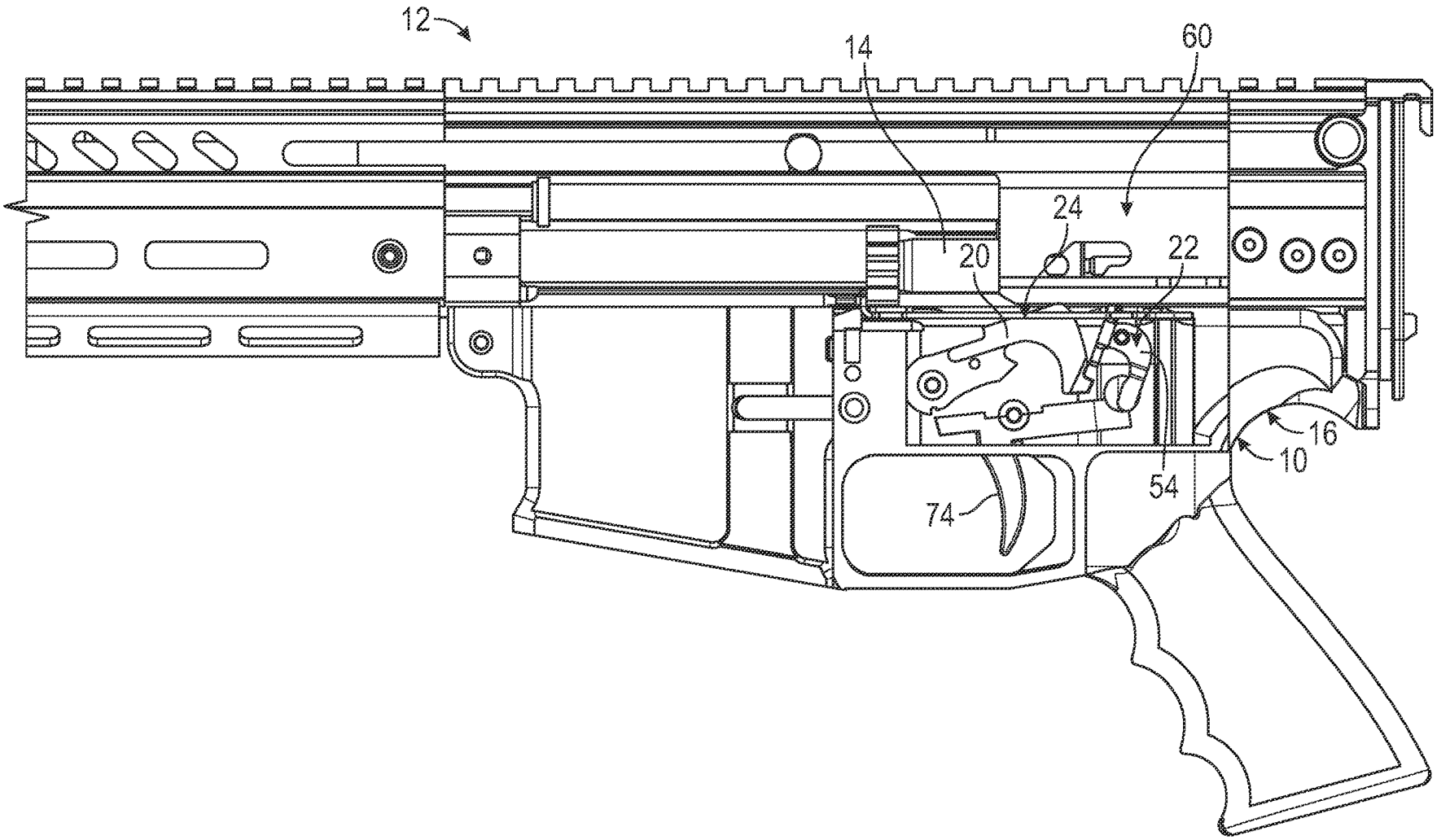
FIG. 6C is a side cutaway view of the firearm assembly of FIG. 1 with the bolt carrier assembly at the farthest rearward position in the full recoil condition.

In FIG. 6B, the rifle 12 is shown immediately after a round has discharged. The bolt carrier assembly 60 is moving rearwards along with the elongated link 24. As the bolt carrier assembly moves rearwards, the bolt carrier assembly resets the hammer 20 towards the full reset position where the hammer will be constrained by the sear 22. Both the bolt carrier assembly and elongated link have moved out of the firing position. The elongated link is move rearwards by both the force of recoil and rearward spring tension exerted by the sear.

In FIG. 7C, the rifle 12 is shown with the bolt carrier assembly 60 at the farthest rearward position in the full recoil condition. The hammer 20 has pivoted past the full reset point and is positioned to be caught by the sear 22 when the bolt carrier assembly moves forward into battery. The head of the bolt 14 is fully extended from the bolt carrier assembly, which only happens when the bolt carrier assembly is in the farthest rearward position. The elongated link 24 is near its reset point, but is unable to engage any components until the bolt carrier assembly has returned to the in battery position and contacted the bolt engagement element 34.

Figure 6D:
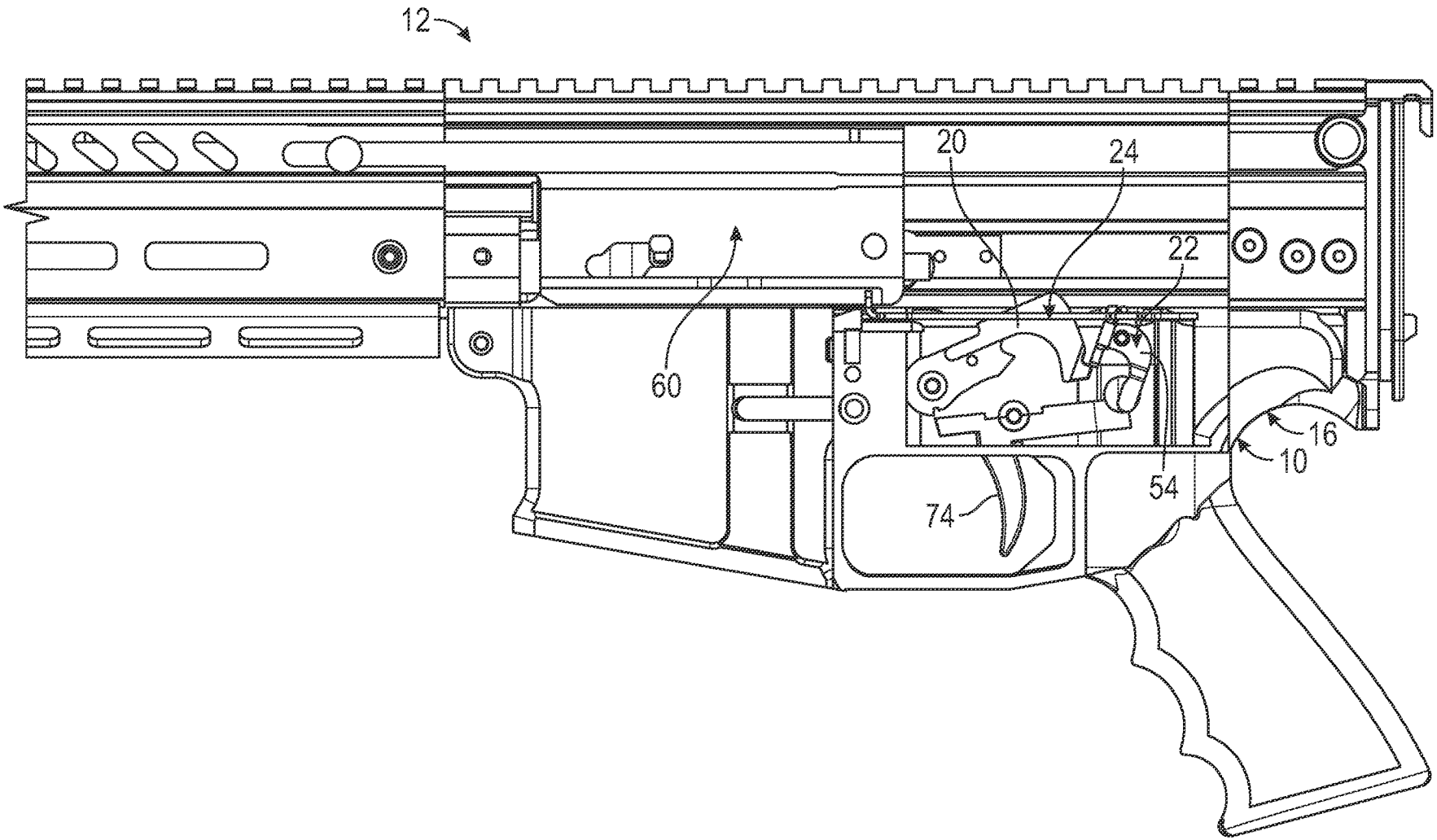
FIG. 6D is a side cutaway view of the firearm assembly of FIG. 1 with the bolt carrier assembly in the process of returning to the in battery position.

In FIG. 6D, the rifle 12 is shown with the bolt carrier assembly 60 in the process of returning to the in battery position. At this point in the cycle, the hammer 20 is reset and restrained by the sear 22. The bolt carrier assembly has stripped a new round from the magazine (not shown) and is in the process of chambering the round. Provided the trigger 74 remains pulled, the hammer will be released by the sear to fire the new round once the bolt carrier assembly has returned to the in battery position and contacted the bolt engagement element 34 on the elongated link 24. When the bolt carrier assembly contacts the bolt engagement element, the sear engagement element 36 simultaneously interfaces with the sear to cause the sear to release the hammer.

Figure 6E:
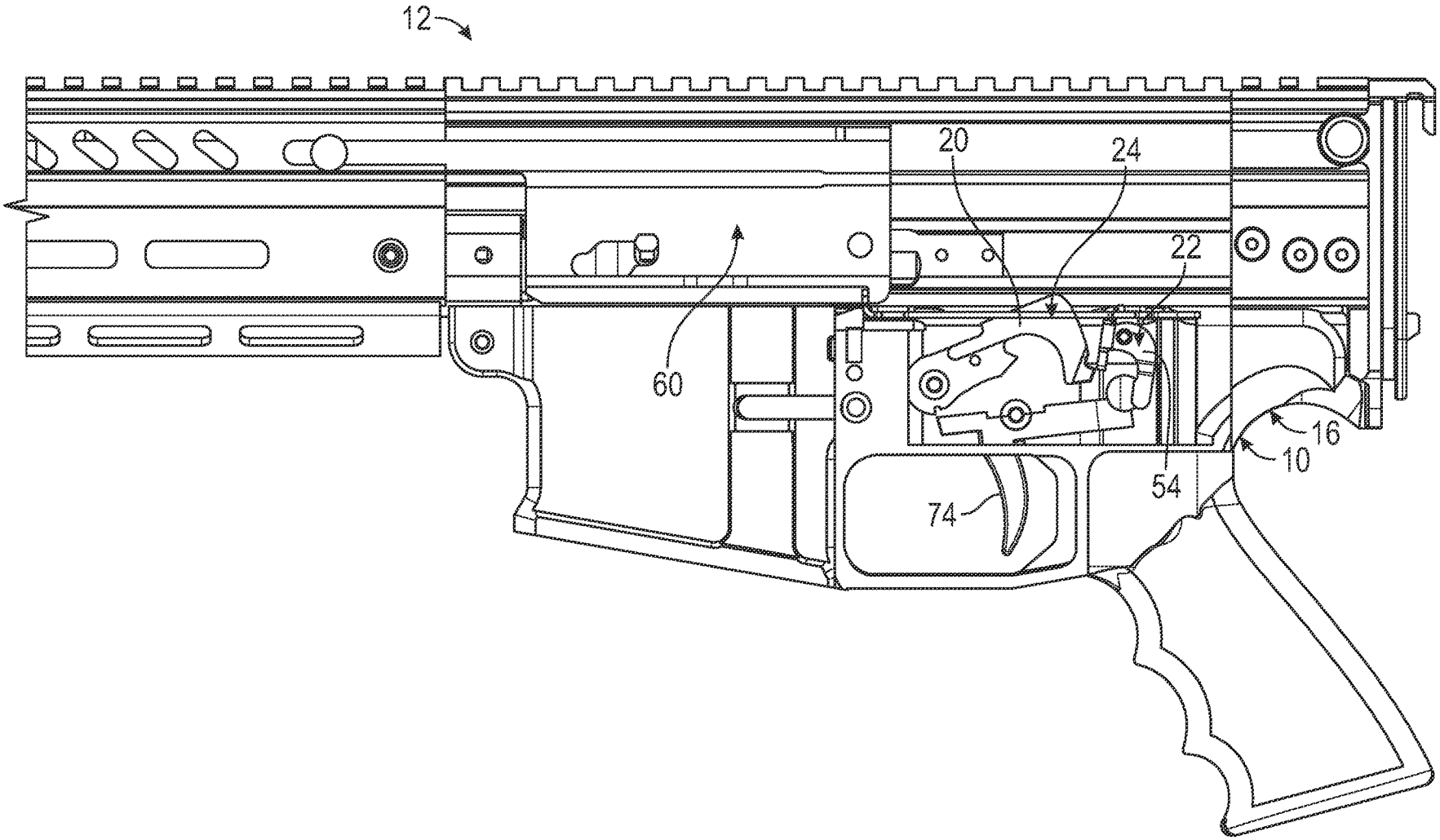
FIG. 6E is a side cutaway view of the firearm assembly of FIG. 1 with the bolt carrier assembly 60 returned to the in battery position.

In FIG. 6E, the rifle 12 is shown with the bolt carrier assembly 60 returned to the in battery position. The bolt carrier assembly has contacted the bolt engagement element 34 on the elongated link 24. This contact pulls the elongated link forward. Simultaneously, the sear engagement element 36 pulls the sear 22 forward, which releases the hammer 20 for firing. Provided the trigger 74 remains pulled, the hammer goes forward and strikes the firing pin, returning the rifle to the condition shown in FIG. 6A. While the trigger remains pulled, the sequence of events will continue and repeat until either the trigger is released, or the magazine is empty.

In the context of the specification, the terms "rear" and "rearward," and "front" and "forward," have the following definitions: "rear" or "rearward" means in the direction away from the muzzle of the firearm while "front" or "forward" means it is in the direction towards the muzzle of the firearm.

While current embodiments of a firearm assembly have been described in detail, it should be apparent that modifications and variations thereto are possible, all of which fall within the true spirit and scope of the invention. Although rifles have been disclosed, the firearm assembly is also suitable for use with shotguns, light and medium machine guns, and other firearms. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A firearm assembly for a firearm having a reciprocating bolt, the assembly comprising:

a lower receiver frame having an upper surface defining a horizontal plane;

a hammer pivotally connected to the lower receiver frame;

a sear pivotally connected to the lower receiver frame and movable between a retention position operable to restrain the hammer and a release position operable to enable striking motion of the hammer;

an elongated link having a planar form overlaying the upper surface of the lower receiver frame;

the elongated link having opposed major upper and lower surfaces, a forward end, and an opposed rear end, and movable between a link forward position and a link rearward portion;

the link forward end having a bolt engagement element;

the elongated link having a sear engagement element protruding away from at least one of the upper and lower surfaces;

the sear having a portion operably engaged by the sear engagement element; and wherein the portion of the sear extends overhanging above a portion of the major upper surface of the elongated link.

2. The firearm assembly of claim 1 wherein the sear engagement element is a vertical protrusion.

3. The firearm assembly of claim 1 wherein the bolt engagement element protrudes upwardly.

4. The firearm assembly of claim 1 including opposed lateral extensions of the sear in opposite directions, each above a portion of the elongated link.

5. The firearm assembly of claim 1 wherein the portion of the sear extends below a portion of the lower surface of the elongated link.

6. The firearm assembly of claim 1 wherein the elongated link defines an aperture configured to receive a portion of the hammer.

7. A firearm assembly for a firearm having a reciprocating bolt, the assembly comprising:

a lower receiver frame having an upper surface defining a horizontal plane;

a hammer pivotally connected to the lower receiver frame;

a sear pivotally connected to the lower receiver frame and movable between a retention position operable to restrain the hammer and a release position operable to enable striking motion of the hammer;

an elongated link having a planar form overlaying the upper surface of the lower receiver frame;

the elongated link having opposed major upper and lower surfaces, a forward end, and an opposed rear end, and movable between a link forward position and a link rearward portion;

the link forward end having a bolt engagement element;

the elongated link having a sear engagement element protruding away from at least one of the upper and lower surfaces;

the sear having a portion operably engaged by the sear engagement element; and wherein the sear engagement element protrudes upwardly from the major upper surface of the elongated link.

8. A firearm assembly for a firearm having a reciprocating bolt, the assembly comprising:

a lower receiver frame having an upper surface defining a horizontal plane:

a hammer pivotally connected to the lower receiver frame;

a sear pivotally connected to the lower receiver frame and movable between a retention position operable to restrain the hammer and a release position operable to enable striking motion of the hammer;

an elongated link having a planar form overlaying the upper surface of the lower receiver frame;

the elongated link having opposed major upper and lower surfaces, a forward end, and an opposed rear end, and movable between a link forward position and a link rearward portion;

the link forward end having a bolt engagement element;

the elongated link having a sear engagement element protruding away from at least one of the upper and lower surfaces;

the sear having a portion operably engaged by the sear engagement element; and wherein the sear engagement element protrudes downwardly from the major lower surface of the elongated link.

9. A firearm assembly for a firearm having a reciprocating bolt, the assembly comprising:

a lower receiver frame having an upper surface defining a horizontal plane;

a hammer pivotally connected to the lower receiver frame;

a sear pivotally connected to the lower receiver frame and movable between a retention position operable to restrain the hammer and a release position operable to enable striking motion of the hammer;

an elongated link having a planar form overlaying the upper surface of the lower receiver frame;

the elongated link having opposed major upper and lower surfaces, a forward end, and an opposed rear end, and movable between a link forward position and a link rearward portion;

the link forward end having a bolt engagement element;

the elongated link having a sear engagement element protruding away from at least one of the upper and lower surfaces;

the sear having a portion operably engaged by the sear engagement element; and wherein the portion of the sear defines a gap receiving a portion of the elongated link.

10. A firearm assembly for a firearm having a reciprocating bolt, the assembly comprising:

a lower receiver frame having an upper surface defining a horizontal plane;

a hammer pivotally connected to the lower receiver frame;

a sear pivotally connected to the lower receiver frame and movable between a retention position operable to restrain the hammer and a release position operable to enable striking motion of the hammer;

an elongated link having a planar form overlaying the upper surface of the lower receiver frame;

the elongated link having opposed major upper and lower surfaces, a forward end, and an opposed rear end, and movable between a link forward position and a link rearward portion;

the link forward end having a bolt engagement element;

the elongated link having a sear engagement element protruding away from at least one of the upper and lower surfaces;

the sear having a portion operably engaged by the sear engagement element; and wherein the aperture has a rear boundary, and wherein the sear engagement element is forward of the rear boundary.

11. A firearm assembly for a firearm having a reciprocating bolt, the assembly comprising:

a lower receiver frame having an upper surface defining a horizontal plane;

a hammer pivotally connected to the lower receiver frame;

a sear pivotally connected to the lower receiver frame and movable between a retention position operable to restrain the hammer and a release position operable to enable striking motion of the hammer;

an elongated link having a planar form overlaying the upper surface of the lower receiver frame;

the elongated link having opposed major upper and lower surfaces, a forward end, and an opposed rear end, and movable between a link forward position and a link rearward portion;

the link forward end having a bolt engagement element;

the elongated link having a sear engagement element protruding away from at least one of the upper and lower surfaces;

the sear having a portion operably engaged by the sear engagement element; and including sear engagement elements on opposed sides of the aperture.

12. A firearm assembly for a firearm having a reciprocating bolt, the assembly comprising:

a lower receiver frame having an upper surface defining a horizontal plane;

a hammer pivotally connected to the lower receiver frame;

a sear pivotally connected to the lower receiver frame and movable between a retention position operable to restrain the hammer and a release position operable to enable striking motion of the hammer;

an elongated link having a planar form overlaying the upper surface of the lower receiver frame;

the elongated link having opposed major upper and lower surfaces, a forward end, and an opposed rear end, and movable between a link forward position and a link rearward portion;

the link forward end having a bolt engagement element;

the elongated link having a sear engagement element protruding away from at least one of the upper and lower surfaces;

the sear having a portion operably engaged by the sear engagement element; and wherein the sear includes a sear body operably connected to the lower receiver frame, and a sear extension including the portion of the sear.

13. The firearm assembly of claim 12 including a spring operably engaged to bias the sear in a selected direction, and wherein the sear extension is interposed between a portion of the spring and the sear body.

14. The firearm assembly of claim 13 wherein the spring biases the sear extension against the sear body.

15. A firearm assembly for a firearm having a reciprocating bolt, the assembly comprising:

a lower receiver frame having an upper surface defining a horizontal plane;

a hammer pivotally connected to the lower receiver frame;

a sear pivotally connected to the lower receiver frame and movable between a retention position operable to restrain the hammer and a release position operable to enable striking motion of the hammer;

an elongated link having a planar form overlaying the upper surface of the lower receiver frame;

the elongated link having opposed major upper and lower surfaces, a forward end, and an opposed rear end, and movable between a link forward position and a link rearward portion;

the link forward end having a bolt engagement element;

the elongated link having a sear engagement element protruding away from at least one of the upper and lower surfaces;

the sear having a portion operably engaged by the sear engagement element;

wherein the elongated link defines an aperture configured to receive a portion of the hammer; and including a sear engagement on one side of the aperture.

* * * * *